US006220447B1

(12) United States Patent
Lambert

(10) Patent No.: US 6,220,447 B1
(45) Date of Patent: Apr. 24, 2001

(54) VARIABLE FREQUENCY SCREENING APPARATUS

(76) Inventor: Gene F. Lambert, 2023 Cochran Rd., Maryville, TN (US) 37801

( * ) Notice: Subject to any disclaimer, the term of this patent is extended or adjusted under 35 U.S.C. 154(b) by 0 days.

(21) Appl. No.: 09/251,785

(22) Filed: Feb. 17, 1999

Related U.S. Application Data

(63) Continuation of application No. 08/720,362, filed on Sep. 27, 1996.

(51) Int. Cl.[7] ..... B07B 1/54

(52) U.S. Cl. ..... 209/382; 209/363; 209/379; 209/381

(58) Field of Search ..... 209/363, 379, 209/381, 382

(56) References Cited

U.S. PATENT DOCUMENTS 3,070,230 * 12/1962 Peterson .
3,796,311 * 3/1974 Krause ..... 209/275
4,122,006 * 10/1978 Christensen et al. ..... 209/382
5,456,364 * 10/1995 Lambert ..... 209/382

* cited by examiner

*Primary Examiner*—Donald P. Walsh
*Assistant Examiner*—Jonathan R. Miller
(74) *Attorney, Agent, or Firm*—Geoffrey D. Kressin

(57) ABSTRACT

A variable frequency screening device consisting of a pair of spaced elongated side members, a flexible screen surface supported between the side members, a frame member supported between the side members and beneath a flexible screen surface, at least one striking frame shaft rotatably mounted between the elongated side members and beneath the flexible screening material, a striking frame mounted to the striking frame shaft, a second striking frame mounted to the striking frame shaft, and a motor to rotate the striking frame shaft which, in turn, causes the first and second striking frames to alternately strike the underside of the flexible screen material. The apparatus is equipped to permit the striking frames located on additional striking frame shafts to strike the screening material at independently selected amplitudes and frequencies.

1 Claim, 3 Drawing Sheets

VARIABLE FREQUENCY SCREENING APPARATUS

This application is a continuation of application Ser. No. 08/720,362 filed Sep. 27, 1996.

BACKGROUND OF THE INVENTION

The present invention relates to a powered screening apparatus, and more particularly, to a variable frequency screening apparatus used to separate and sort multiple size solids and particulates.

Vibrating screen arrangements have been used for many years in gravel and rock quarrying for sizing rock product and/or for removing undesirable material from the eventual finished product. Generally, the arrangements comprise a working member supported on a frame and an exciter arranged to impart vibrating motion to the member. The working member is fitted with a screen deck with a conventionally rigid aperture element which may be made up of a plurality of screening panels.

Despite the fact that the working member is vibrated in use, blinding of the apertures in the screening material occurs. When blinding occurs, separation of particulates becomes less uniform and less efficient. It is, therefore, an object of this invention to reduce blinding and improve efficiency.

Vibrating screen decks have been used widely in the past for separating particulates of various sizes and composition. Such screening decks typically comprise a rectangular frame suspended in operation with screen cloth mounted within the frame from which the materials are separated. The frame and screen in such decks are suspended at an angle. The entire frame is vibrated, thus imparting vibration to the machine which in turn causes the solids to move down the screen. As materials move down the vibrating screen, the solids of smaller mesh size pass through the screen with larger solids discharged from the lower end of the screen.

One disadvantage of such prior screening devices is imparting vibration to the entire system without a corresponding reduction in the blinding. Decks of this size can typically employ motors of forty horsepower (40 h.p.) or more. Another disadvantage of such prior decks is the susceptibility of frequent maintenance because the vibration is imparted to the entire deck for sustained lengths of time thus causing stress on joints of various fitted parts. Accordingly, it is an object of this invention to reduce stress on the joints of the various fitted parts.

Other screening apparatus have been developed which attempt to reduce a substantial energy requirement in such devices. In these apparatus, a plurality of small vibrator motors have been employed which are coupled to tappet shafts extending beneath the screen material at various locations spaced along the length of the screen. The tappet shafts are coupled by relatively complex linkages to a vibrator motor on the exterior of the frame deck. A plurality of tappet shafts or arms are positioned on the shaft which move eccentrically to strike the screen from beneath. The particular tappet arrangements in such decks necessitate relatively complex linkages and cause localized tapping of the screen both of which result in concentrated wear. Such power screening decks require frequent adjustment to keep the screen in contact with the tappets. Such prior screening decks are also susceptible to frequent blinding. It is, therefore, an object of this invention to eliminate the complex linkages, reduce frequent necessity for adjustment and increase the efficiency of the screening deck.

Yet another disadvantage of such prior screening devices is the inability to independently adjust the frequency with which various tappets spaced beneath the screen strike the screen. With other devices, the frequency with which tappets strike the screen is uniform. This uniform frequency causes a constant motion to the screening surface which in turn exacerbates blinding. It is, therefore, an object of this invention to permit the relative frequency that the tappets strike the screen to be selectively adjusted to vary the screen vibration which in turn reduces blinding and improves screening efficiency.

SUMMARY OF THE INVENTION

According to the invention, a screening arrangement defining a feed end and a discharge end comprises a pair of elongated side members extending between the feed end and a discharge end, a pair of support members each attached to opposing elongated side frame members, at least one screen deck comprised of a flexible material extended between and secured to the screen support members, a first striking frame arm shaft rotatably attached to opposing sides of said elongated side members, a second striking frame arm shaft rotatably mounted to said elongated side members and spaced from said first striking frame shaft, a pair of striking frames mounted to each striking frame shaft which alternately strike the under side of the screen material as each striking frame shaft pivots, means to selectively pivot each striking frame shaft such that said striking frames on each shaft to strike the screen material, a striking frame arm attached at one of its ends to one end of said shaft, and a connecting arm rotatably attached at its ends to and between the opposing ends of each striking frame arm. The screen apparatus may be held or supported at an angle with the discharge end lower than the feed end, thus permitting the screen material to form a downward slope which in turn permits particulates which do not fall through the screening material to discharge through the lower end or discharge end.

These and other objects, features and advantages of the present apparatus will be clearly understood to those skilled in the arts.

DESCRIPTION OF THE PREFERRED EMBODIMENT

Figure 3:
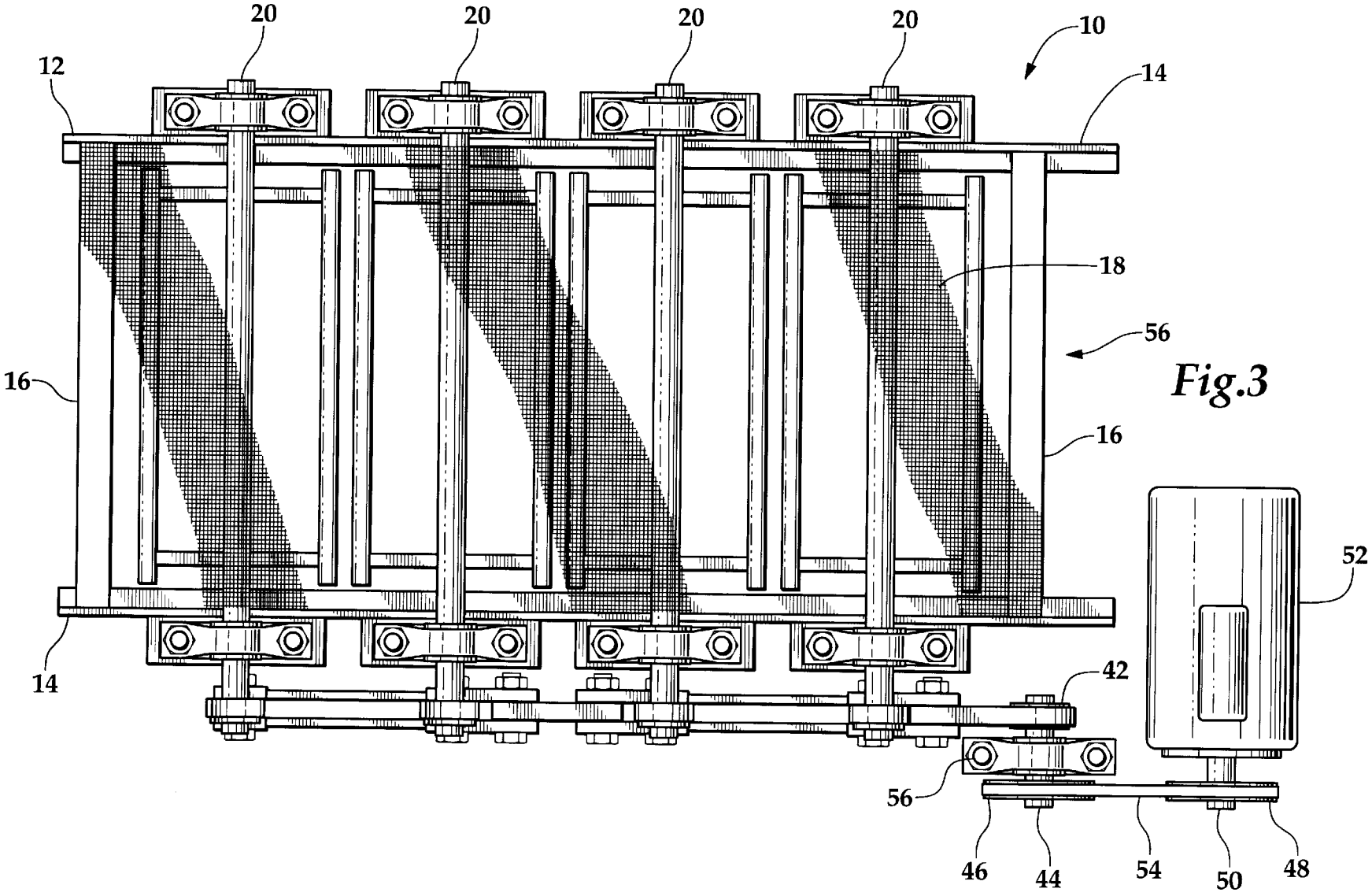
FIG. 3 is a top view of the variable frequency screening apparatus showing the components of the apparatus.

An overall view of the powered screening apparatus is shown in FIG. 3.

Figure 1:
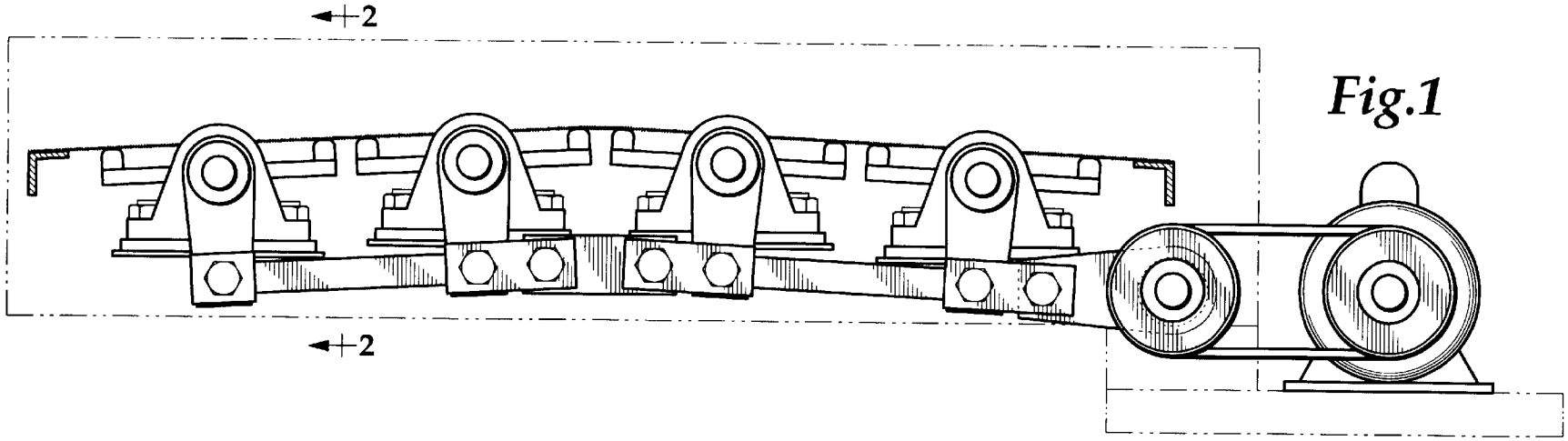
FIG. 1 is a side view of the preferred embodiment of the variable frequency screening apparatus showing the components of the apparatus.
Figure 2:
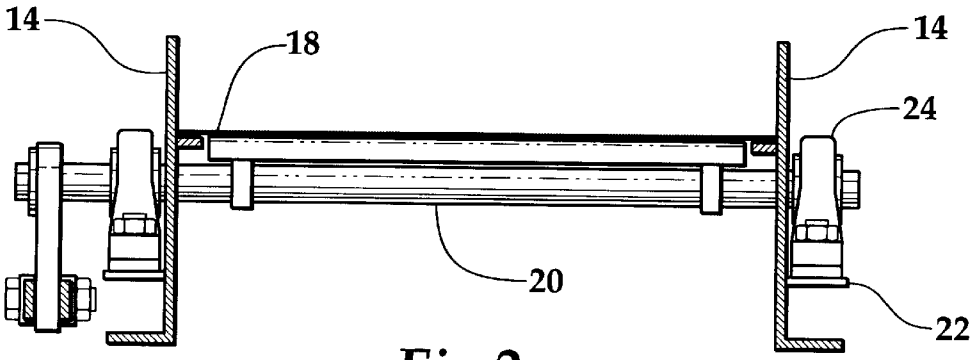
FIG. 2 is an end elevation view of the variable frequency screening apparatus as viewed substantially along the line 22 of FIG. 1 showing the striking frame in contact with the screening material.

The screen apparatus 10 comprises a generally rigid frame 12, having a pair of longitudinally extended elongated side members 14 such as channel beams as shown in FIGS. 2 and 3. The elongated frame members 14 are held apart and spaced in generally parallel relationship to each other by transverse members 16 as shown in FIG. 3. These transverse members 16 also provide support for the screening material 18.

Screening material 18 is contained within the frame 12. Solids and particulates pass over the screening material 18 to be separated. Transverse members 16 are attached conventionally such as by welding to opposing sides members 14.

At least one pair of striking frame shafts 20 are spaced generally parallel to transverse member 16 and beneath screening material 18. Striking frame shafts 20 are pivotally attached to frame members 14. A rigid shelf member 22 is provided outboard of frame members 14. A conventional bearing 24 is attached to shelf 22 on opposing sides of frame members 14. Bearings 24 are arranged to carry striking frame shafts such that striking frame shafts 20 are essentially perpendicular to the inboard portion of frame members 14 and beneath screen material 18.

A first striking frame 26 is attached to each striking frame shaft 20 essentially along its length beneath the screening material 18. A second striking frame 28 is attached to striking frame shaft 20 essentially parallel to striking frame shaft 20 and essentially parallel to first striking frame 26. The second striking frame 28 is mounted beneath screening material 18. First striking frame 26 and second striking frame 28 are attached conventionally to striking frame shafts 20 as by welding. Said first and second striking frames may be selectively distanced from said shaft by elongating or shortening striking frame arm 27 and arm 29 on said first and second striking frames.

A means for imparting motion and vibration to the screening material is generally shown at 30. A striking shaft arm 32 is attached at each end 31 of striking frame shaft 20 outboard of frame members 14. Connecting arms 34 are connected at end 36 of the striking shaft arms. Each end 36 of each connecting arm 34 is rotatably attached to end 36 of each striking shaft arm 32. An eccentric shaft arm 38 is connected at one end 40 to a link 41. The other portion of link 41 is attached to striking shaft arm 32 near the end 36 of striking shaft arm. The opposite end 42 of eccentric arm 38 is attached to one end of eccentric shaft 44. A sheave 46 is attached to eccentric shaft 44. A second sheave 48 is attached to shaft 50 of a conventional electric motor 52. Sheaves 46 and 48 are aligned such that drive belt 54 permits sheave 48 to drive sheave 46. Eccentric shaft 44 is rotatably attached through bearing 56 and is attached outboard to frame member 14.

An important feature of the present invention is controlling the frequency and amplitude of the individual striking frames thus varying the screen vibration over the length of the screen during operation. Various materials separate better by imparting different frequencies and amplitudes of vibration to the screen material. Accordingly, the ability to control the frequency and amplitude of each striking frame at different locations along the screen is a desired quality of the present invention. To this end, the length of the striking frame arm 27 and the length of the striking shaft arm 32 may be selected to achieve the desired amplitude at each location along the screen.

Vibration control circuits for motor 52 have not been shown because they are within the selection of one skilled in the art from a wide range of speed controls which have been employed for other purposes. It will be recognized by those skilled in the art that varying the speed of motor 52 will provide additional control of the frequency of the vibration imparted to screen material 18.

The operation of the variable frequency screening apparatus according to the invention is as follows:

The bulk material is loaded at the feed end 56 onto the stop of screening surface 18. As a result of the vibrations imparted to the screening material, the bulk material moves down along the screening material 18. As the material moves along the screening material 18, smaller particles drop through the apertures in the screening material 18.

Figure 4:
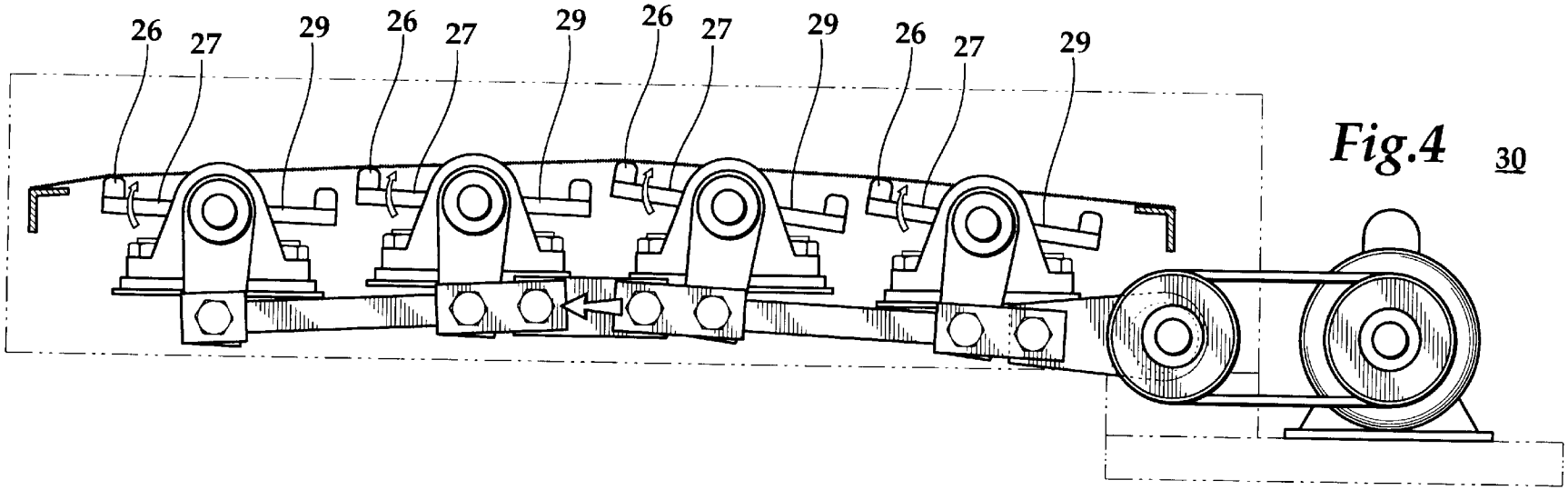
FIG. 4 is a cross-sectional and elevational view of the variable frequency screening apparatus showing first striking frames in contact with the screening material.
Figure 5:
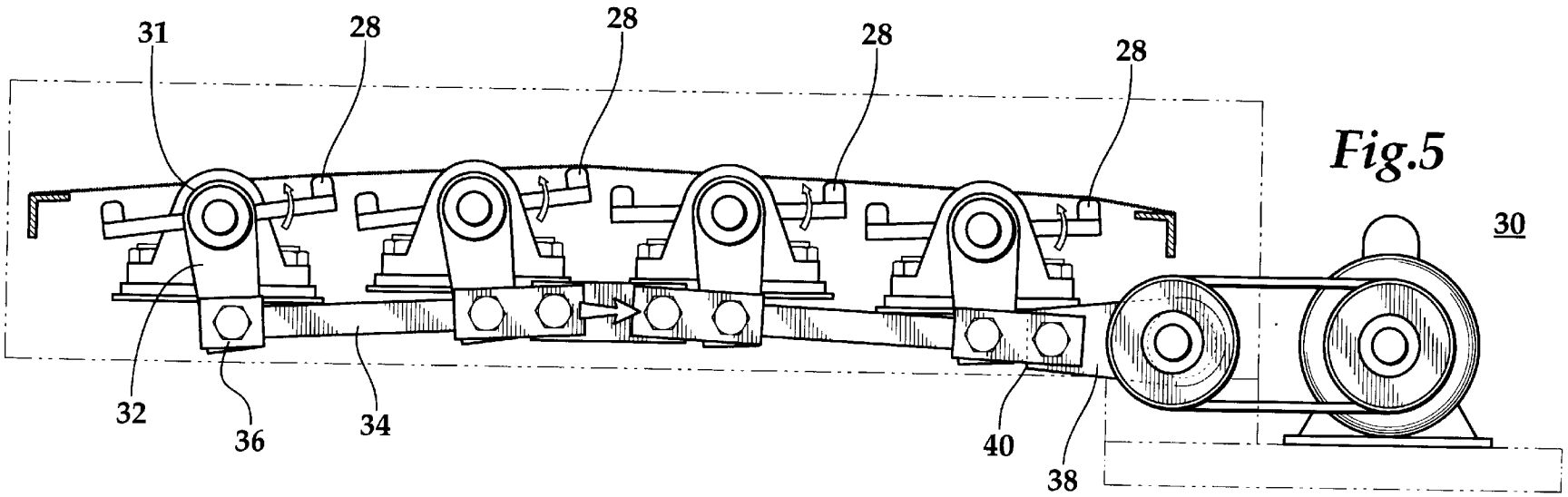
FIG. 5 is a side elevational view of the variable frequency screening apparatus showing second striking frames in contact with the screening material and the first striking frames withdrawn from the screening materials.

The vibration is imparted to the screening material by activating motor 52. As first striking frame 26 strikes the under surface of screening material 18, the second striking frame 28 rotates away from and out of contact with the under surface of screening material 18. This motion is illustrated in FIG. 4. As striking frame 26 rotates downward away from the under side of the screening material 18, second striking frame 28 rotates upward and strikes the under side of screening material 18. This motion is illustrated in FIG. 5. The alternating or oscillating of first striking frame 26 and second striking frame 28 at various frequencies causes a flexing of screen material 18 thus eliminating blinding of the screening material.

Although the invention is described and illustrated with Preference to a specific embodiment thereof, it is to be expressly understood that it is in no way limited to the disclosure of such a preferred embodiment, but is capable of numerous modifications within the scope of the intended claims.

What is claimed is:

1. A variable frequency screening apparatus for separating bulk granulated material comprising:

A pair of spaced elongated side members;

A flexible screen supported between said side members;

At least one transverse member supported between said side members;

At least one pair of striking frame shafts pivotally connected at each end between said members beneath said flexible screen;

At least one selected length striking frame arm attached at one end to each of said striking frame shafts;

A first striking frame in partial contact with said flexible screen mounted to the other end of each striking shaft arm beneath said flexible screen;

At least a second selected length striking frame arm attached at one end to each said striking frame shaft whereby said selected length may be unequal to the length of first striking shaft arm;

A second striking frame in partial contact with said flexible screen mounted to the other end of each said second striking frame arms;

A first striking shaft arm attached at one end of said striking frame shaft mounted outboard of said frame members;

A second striking shaft arm attached at one end of said second striking frame shaft mounted outboard of said frame members;

A selected length connecting arm pivotally attached at one end to a second end of said striking shaft arm and a second end pivotally attached at a second end of said second striking shaft arm;

A selected length link arm attached at one end to the second end of the striking shaft arms;

An eccentric arm pivotally attached to said second end of said link arm;

An eccentric shaft pivotally attached to the other said end of said eccentric arm; and Means for selectively rotating said eccentric shaft whereby said first and second striking frames alternatively strike said flexible screen.

* * * * *